US006041483A

United States Patent [19]

Burch

[11] Patent Number: 6,041,483

[45] Date of Patent: Mar. 28, 2000

[54] FUNERARY URN

[75] Inventor: Richard A. Burch, Evansville, Ind.

[73] Assignee: Design Cast Studios LLC, Henderson, Ky.

[21] Appl. No.: 08/856,984

[22] Filed: May 15, 1997

[51] Int. Cl.[7] ..... A61G 17/00

[52] U.S. Cl. ..... 27/1

[58] Field of Search ..... 27/1; 441/1, 6, 441/32

[56] References Cited

U.S. PATENT DOCUMENTS

| | | | |
|---|---|---|---|
| 3,126,559 | 3/1964 | Alexander | 441/32 X |
| 3,732,602 | 5/1973 | Vigh | 27/1 |
| 3,822,499 | 7/1974 | De Vos | 441/32 X |
| 5,239,733 | 8/1993 | Vail, III et al. | 27/1 |
| 5,393,253 | 2/1995 | Humble et al. | 27/1 X |
| 5,774,958 | 7/1998 | Casimir | 27/1 |

*Primary Examiner*—Terry Lee Melius
*Assistant Examiner*—William L. Miller
*Attorney, Agent, or Firm*—Schwegman, Lundberg, Woessner & Kluth, P.A.

[57] ABSTRACT

A funerary urn comprises a top, a bottom and side walls connecting the side and bottom. The urn has an open area within a first storage space, the opening having a volume of between 0.25 and 2.5 cubic feet being defined by the top, bottom and side walls. The top, bottom and side walls have openings therein which allow passage of water into the storage space and allow air to pass out of the storage space. The urn, when it contains the ashes of a cremated animal and then immersed in water will attain a specific gravity of greater than 1.0 within three minutes. At least 80% by weight of the top, bottom and side walls consist essentially of materials which would decompose, degrade, dissolve or disperse in water so that the urn will lose its structural integrity within twelve months of continued immersion in water at 20° C.

14 Claims, 1 Drawing Sheet

FUNERARY URN

BACKGROUND OF THE INVENTION

1. Field of the Invention

The present invention relates to urns for the disposal of the ash remains of cremated bodies and more particularly to biodegradeable funerary urns which will decompose into an environmentally safe material after prolonged contact with moisture or submersion in water.

2. Background of the Art

One of the first practices which distinguish developing cultures is the respect shown to the environment and to the remains of the dead. Most cultures and religions have developed their own distinctive formalities and requirements with respect to the treatment of the remains of the dead, but only the more naturalistic religions are there specific doctrines or practice which relate to the relationship of people and the environment described in basic religious practice.

Most of the religions which predominate in western culture practice burial rituals in the consecration of the remains of the departed. With the dramatic increases in population throughout the world, however, the cost and large areas of land use for burial practice have led to serious concerns about the desirability of interment as a continuing practice. Many religions and cultures have identified cremation as a means of reducing the space requirements for burial and for reducing the costs of burial practices. The reduction in volume of the remains, from an average of 1 cubic meter to 0.25 (¼) cubic meters or less of actual ash, and the reduction of typical containment vessels (e.g., coffins) from 2.5 to 3 cubic meters down to about 0.3 cubic meters or less for urns offers at least the opportunity for reducing the space requirements for interment facilities, whether they be classic earth interment (burial) or more recently introduced compartmentalized facilities where caskets are housed in building structures. Only recently, the ashes of some individuals have been orbited around the Earth, with an expectation that their urns will incinerate upon reentry into the atmosphere after many years. This is a costly method of positioning remains for disposal and adds to the clutter in space about the Earth. Although these techniques improve land use space efficiency in funeral practices, the reduction or elimination of any land requirements, or the ability to turn over land use for burial would be desirable. Even though the open scattering of ashes has been accepted by many people, there is significant resistance to this practice.

Cremation has been practiced by many different religions and cultures and has involved either simple burning and distribution of the ashes or more elaborate ceremonial events with confining structures burned along with the remains. Such practices have involved, for example, either simple pyres upon which the remains and fuel have been stacked

SUMMARY OF THE INVENTION

Ashes from the cremation of bodies (either persons or lesser animals) are placed into a container which is readily decomposable and/or biodegradable. Both the composition and structure of the container, e.g., a funerary urn, are designed and selected to meet specific goals and objectives in the use of the urn. Not only must the composition be compatible with the environment, but the urn should be designed to facilitate submersion in water environments and decomposition in a controlled amount of time. When used in water, the urn must sink at a significant rate so that the remains are in fact interred, yet no decompose so rapidly that the remains will be exposed to the observers during the burial procedure.

DETAILED DESCRIPTION OF THE INVENTION

Figure 1:
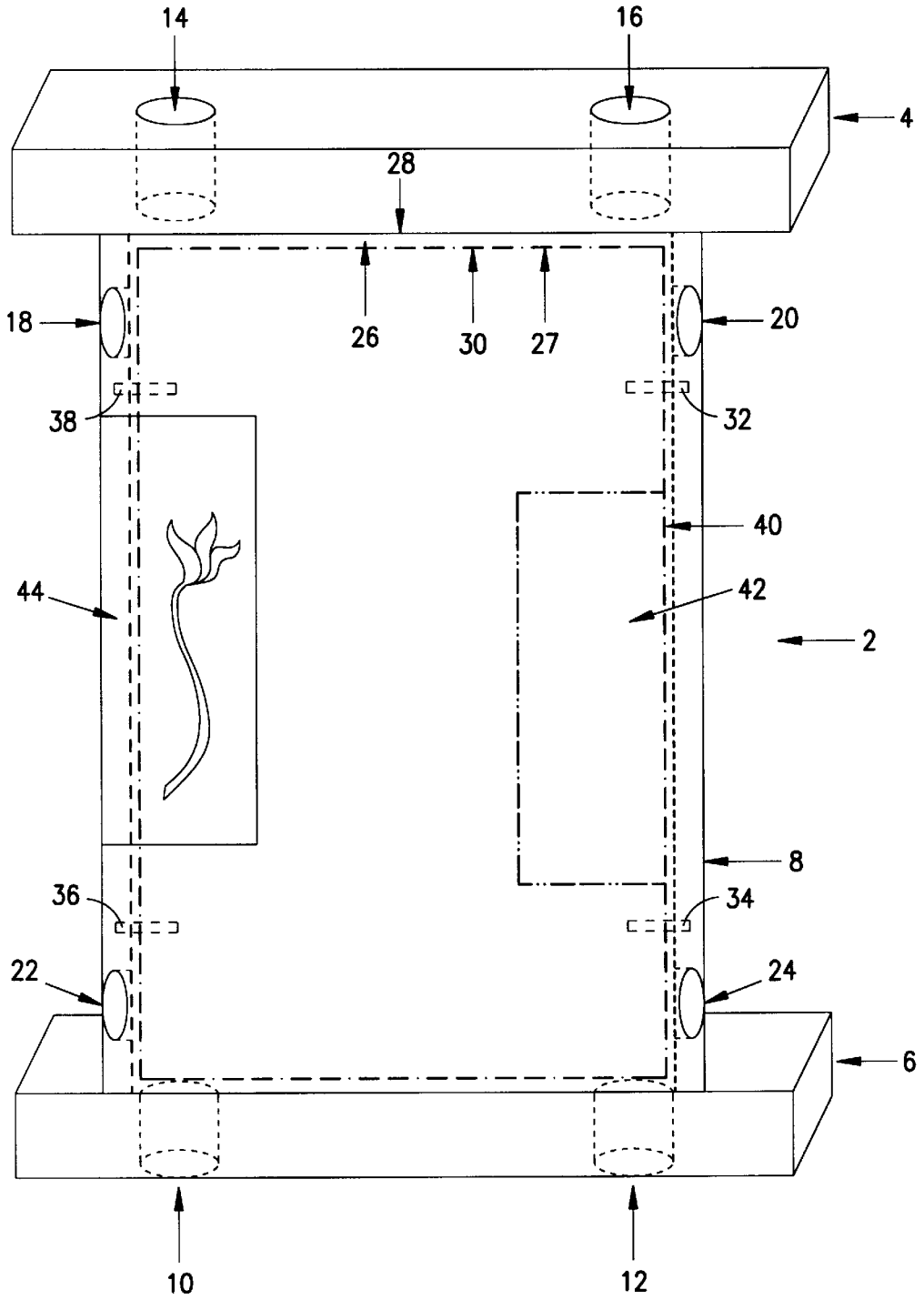
FIG. 1 shows a cross-section of a funerary urn of the present invention which has been deigned for submersion in water.

A container is described for the environmentally acceptable disposal of the ash remains of cremated bodies. The container may have any shape, either traditional rectangular sides, or may be shaped to the individual election of the deceased or relatives. For example, shapes of animals, buildings, or items which were especially important to the deceased are contemplated in the practice of the present invention.

The two most important structural considerations in the design of the urn of the present invention are the material composition of the urn itself, and, especially where burial in a water rich environment is considered, structural design to assure submersion of the urn so that it neither floats for an excessive period of time, nor releases its ash content too quickly, possibly leading to distress of the friends and relatives gathered at the ceremony.

The composition of the urn must be composed of materials which are structural self-supporting (rather than flimsy) to contain the remnants securely before interment, environmentally compatible so that disposal of the urn and its environmentally acceptable contents do not adversely affect the environment into which it is placed, and the composition must break down and/or decompose so that a permanent container is not introduced into the environment, thereby defeating a primary purpose of the container.

The composition of the urn should be comprised of materials from within the following general classes: 1) natural biodegradable components, 2) synthetic biodegradable components, and 3) environmentally safe, inert components. The biodegradable components should be in a form which promotes their decomposition. For example, wood fibers would be a useful component for a funerary urn, but they should not be in the form of wood planking, but rather in more particulate or fibrous form to expose the cellulosic substance of the wood to the environment to accelerate decomposition and degradation. Similarly, fibers from plants, grain residue (e.g., soy bean residue, chaff, whey, and the like), cotton, modified cellulose materials, straw, ground corn husk, shredded bark, and the like are best used when pressed with a decomposing binder when the fibers are of thin diameter and short length. Natural resins (such as gelatin, agar gum, sugar and starch based viscous solutions, chitin, tree rosins and sap, and other natural materials) are useful binders for the more particulate or fibrous structural component of the composition. The resins should be chosen to assure that they soften within the appropriate time frame during the conditions to which the funereal urn is exposed. For example, if the urn is to be placed within a moist earthen environment, the natural resin should readily decompose or even be ingested by bacteria or insects in the soil. To this end, saccharides, sugars, and starch binders would add sufficient strength to the urn for ambient storage, but would decompose in the soil either by gradual decomposition or by assisted breakdown by bacteria or lower life forms( such as insects). If the urn is to be deposited in an aqueous environment, the binder would probably need to be a little more persistent and resistant to dissolution in water so the urn would not begin to decompose while it was still within view of persons attending the release of the urn. Higher molecular weight starches and sugars, control over the concentration of the sugars and starches, the use of more oleophilic gums and resins (such as the tree saps and rosins), higher compacting pressures, and the like would be used to control the rate of structural breakdown on the urn. Synthetic materials which will decompose or degrade in the selected interment environment would also be useful. Such conventional binders which are known to decompose at a controlled rate in aqueous environments, such as polyvinyl alcohol, polyvinyl pyrrolidone, low molecular weight, two dimensional acrylic polymers, certain cellulosic resins, and the like would be useful to this end. Because of the ability to control the molecular weight, the balance of two and three dimensional crosslinking in the polymer, and the particular substituents which would be present on the polymer, the decomposition/degrading properties of the synthetic polymer are readily controlled and tailored for any intended use. Inert binders and fillers such as clays, silica, dyes, pigments, decorative elements, mesh for structural support, and the like may also be present. Under ideal conditions, each of the materials in the urn would be environmentally safe and decompose within an appropriate time frame (such as from minutes to months). The urn should be composed of materials in such a structural form that the entire urn does not disintegrate in less than two minutes when deposited in still water (either pure water or salt water as the appropriate test is selected for the appropriate release) at 20° C. It is likewise desired that the urn composition does not persist for more than twelve months, retaining its structural integrity. It is more preferably that when deposited in still water at 20° C., the structure will not remain structurally self supporting when removed from still water at 20° C. after six months immersion.

Other components of the urn structure would include commercially available medium density fiberboard (MDF), which is at least in part composed of the more fundamental ingredients described above, cardboard tubing, paper (especially filter paper with controlled water porosity), cast paper (cotton fiber, art paper), physical securement elements such as bolts, screws and nails (being chosen of more readily degradable materials such as unplated screws, bolts and nails, and unfinished screws, bolts and nails). Paints and finishes may also be present on the urn to increase its appearance, but these materials should also be safe for the environment and readily dispersible/decomposable/degradable. Water soluble paints, binders with water-soluble dyes, and the like would serve this purpose.

There are essentially only three structural concerns which must be addressed by the urn. The urn must be sufficiently sound as to withstand handling and transportation so that the ashes of the deceased are not prematurely exposed, the urn must degrade/decompose/disperse within a controlled amount of time in the selected disposal environment, and when released into water, the urn should sink within a reasonable amount of time when released. Each of these elements can be readily addressed by one of ordinary skill in the art. The initial structural strength is easily addressed by the selection and means of association of the respective components. The degrading has been discussed above. The flotation requirements, or rather the non-flotation requirements of the present invention when the urn is to be released in a watery environment is analyzed below.

When an urn is to be released into a watery environment such as an ocean, a sea, a lake, a river, a stream or pond, it is an objective of the present invention and the usual desire of the friends and the relatives of the deceased to have the urn sink out of sight. It would clearly be an undesirable event for the urn to float indefinitely and/or return to a shoreline where the remains might be recoverable against the original intent of the funeral. Even though the urn is decomposable and would eventually sink, it is usually the desire of the attendees to perceive some closure of the ceremony with the disappearance of the remains. There are basically two ways in which the urn can be made to sink within a relatively short period of time. The urn, including any open space and the included remains of the deceased, would have to have a specific gravity of greater than 1.0 (for pure water), preferably greater than 1.2, and most preferably greater than 1.4 (to assure descent within salt water). Because of the significant volume of the urn which would comprise the ashes of the deceased, and the fact that the ashes would have a significant air content, to provide the urn with such a specific gravity would require the use of materials with specific gravities much higher than the average goal. As the ashes might have a specific gravity of less than 0.7, the average of the other materials, assuming an equal volume, would have to be at least 1.3, preferably at least 1.7, and more preferably at least 2.1. Materials with such high specific gravities are not likely to be biodegradable. The other means of providing for the urn to sink within a reasonable amount of time would be to have water enter any void areas within the urn, without washing out the remains immediately, and therefore remove the air entrapped within the urn and the materials within the urn.

When water is to enter the urn casing without washing out the ashes contained therein, the water must either fill a large area of the urn which is completely empty and/or enter into the area of the urn containing the ashes without immediately removing the ashes. This last constraint is important as it would not be an intent of the attendees to watch the remains immediately dispersed into the open water. To effect entry of the water without removal of the ashes in an amount that would be readily visible, a membrane of film must be present which would allow water to pass into an area confined by the membrane or film, without allowing the ash to exit through the same membrane or film. Such materials, even in commercial form, are readily available. For example, conventional filter paper would serve the purpose quite easily and well. Filter paper is designed to retain particles and allow liquid to pass through it. As it may also made of biodegradable cellulose fibers, it can be provided as a biodegradable component of the urn of the present invention. By allowing water to fill any air space or air within the ashes, the average specific gravity of the urn and its content can be readily provided at a figure which would exceed that of the liquid environment. By having the remainder of the urn at 1.2, the water would assure that the open areas of the urn (including the accessible area where the ashes are confined) would exceed that of the liquid environment.

A funerary urn of the present invention may be described in general as comprising a top, a bottom, and side walls connecting said top and bottom, said urn having an open area within a first storage space defined by said top, bottom and side walls with between 0.25 and 5 (and preferably between 0.5 and 2.5) cubic feet of space, said top, bottom and side walls having openings therein which will allow passage of water into said first storage space and air out of said storage space, said urn, when containing the ashes of a cremated animal and then immersed in water, will achieve a specific gravity of greater than 1.0 within three minutes, at least 80% by weight said top, bottom and side walls consisting essentially of materials which would decompose, degrade, dissolve, or disperse in water so that said urn will lose its structural integrity within twelve months of continued immersion in water at 20° C. The 80% by eight usually comprises biodegradable materials.

It is preferred that porous material, which will allow passage of water but will not allow movement of at least 50% by weight of ash particles through it, is present between said openings and ash stored within a second storage space within said first storage space. When said urn is placed into water and released, the openings are positioned about the urn so that, no matter what orientation of the urn is effected, at least one opening is below water and at least one opening is above water. These openings may be positioned on the top, the bottom and the side walls of the urn. It is preferred that at least 80% of the urn, excluding ashes contained therein, consists essentially of structural material selected from the group consisting of fiber board, pressed board, cellulose fibers, binder, and synthetic polymer fiber.

These and other aspect of the invention will be even better appreciated with a consideration of the FIGURE of the invention.

FIG. 1 shows a funerary urn 2 of the present invention. This particular urn 2 comprises a top lid 4 and a bottom lid 6. The main casing 8 of the funerary urn 2 is joined to each of the lids 4 and 6. The joint may be by insert ridges, clamps, physical implement securement (e.g., staples, screws, bolts, nails, adhesive, etc. [not shown]) or any other mechanism which keeps the lids 4 and 6 attached to the main casing 8. A series of holes, 10, 12, 14, 16, 18, 20, 22 and 24 are shown. In any single urn 2 all of these holes are not necessarily essential, but this number and positioning of holes shown in the FIG. 1 will assure that water can flow into the urn 2 and air may flow out, irrespective of the initial position at which the urn 2 lands in the water. The holes must be positioned so that whatever position an urn may be rotated to, there is both a hole positioned in the water and a hole positioned out of the water. If a weight is provided (not shown) so that the urn is asymmetrically weighted, a water entry hole would be positioned near or in the direction of the higher weighted end of the urn, and an air exit hole would be positioned on the lower weighted end of the urn. A combination of multiple and distributed holes in both of the lids 4 and 6 and in the main casing 8 at both ends of the urn 2 would assure that any position assumed by an urn when tossed into water would provide holes positioned in the water and outside the water. A core 30 is shown within the urn 2. This core 30 would contain the ashes not shown) of the cremated deceased. The core 30 could be secured to the main casing 8 by any convenient means, but in this Figure, bolts 32, 34, 36 and 38 are shown. The space 26 between the top 27 of the core 30 and the inside edge 28 of the top lid 4 can vary as desired. As water will enter the main casing 8 and fill the core 30, the minimizing of air space is not essential to the practice of the present invention. However, this spacing 26 should be considered in the design because it may be used to control the rate of sinking of the urn 2. By varying the size (volume) of the spacing 26 and the size of the holes 10, 12, 14, 16, 18, 20, 22 and 24 the rate at which water will fill the air space within the urn 2 can be controlled and therefore the time when a specific gravity greater than that of the liquid into which the urn is dropped can be controlled. A large opening or hole 40 is shown in the core 30. The hole 40 is secured by filter paper 42 which allows water to enter the core 30 and prevents any ashes (not shown) from exiting the core 30. The porosity of the filter paper 42 should be selected to reduce, but not necessarily completely eliminate the passage of ashes through the paper. The paper 42 may restrict 100% of the ashes from moving, or as little as 50% of the particle size of the ashes from moving through the paper. Since the movement of water will initially be primarily into the core 3, there would be little movement of ash out of the core, particularly if the time to achieve a specific gravity greater than that of the liquid was readily and quickly achieved. Movement of the ash after filling of the core 30 would be effected mainly by migration (assisted by Brownian motion and eddy currents) of liquid around the core 30. This would probably not cause strongly visible release of ashes until after the urn 2 had sunk out of sight. A picturesque figure 44 is shown on the exterior of the main casing 8. The filter paper 42 may be conventional filter paper as used in chemical laboratories, coffee filters, or the like, and may be fine mesh made of soluble fibers if desired. It main purpose is to prevent premature release of the ashes before the desired time after immersion of the urn and its removal from sight.

What is claimed:

1. A funerary urn comprising a top, a bottom, and side walls connecting said top and bottom, said urn having an open area within a first storage space defined by said top, bottom and side walls with between 0.25 and 5 cubic feet of space, said top, bottom and side walls having openings therein which will allow passage of water into said first storage space and air out of said first storage space, said first storage space having a second storage space therein for containing ashes of a cremated animal and said urn, when containing the ashes of a cremated animal and then immersed in water, will achieve a specific gravity of greater than 1.0 within three minutes, at least 80% by weight said top, bottom and side walls consisting essentially of materials which would decompose, degrade, dissolve, or disperse in water so that said urn will lose its structural integrity within twelve months of continued immersion in water at 20° C.

2. The urn of claim 1 wherein said 80% by weight comprises biodegradable materials.

3. The urn of claim 2 wherein at least 80% by weight of said urn, excluding ashes contained therein, consists essentially of structural material selected from the group consisting of fiber board, pressed board, cellulose fibers, binder, and synthetic polymer fiber.

4. The urn of claim 1 wherein porous material, which will allow passage of water but will not allow movement of at least 50% by weight of ash particles through it, is present between said openings and ash stored within said second storage space within said first storage space, allowing contact of said water and said ash stored within said second storage space.

5. The urn of claim 4 wherein at least 80% by weight of said urn, excluding ashes contained therein, consists essentially of structural material selected from the group consisting of fiber board, pressed board, cellulose fibers, binder, and synthetic polymer fiber.

6. The urn of claim 1 wherein when said urn is placed into water and released, said openings are positioned about said urn that, no matter what orientation of the urn is effected, at least one opening is below water and at least one opening is above water.

7. The urn of claim 6 wherein ashes are present in said urn with a porous material which will allow passage of surrounding water but will not allow movement of at least 50% by weight of said ashes through it, is present between said openings and ashes, allowing contact of said surrounding water and said ash stored within said second storage space.

8. The urn of claim 6 wherein at least 80% by weight of said urn, excluding ashes contained therein, consists essentially of structural material selected from the group consisting of fiber board, pressed board, cellulose fibers, binder, and synthetic polymer fiber.

9. The urn of claim 1 wherein at least 80% by weight of said urn, excluding ashes contained therein, consists essentially of structural material selected from the group consisting of fiber board, pressed board, cellulose fibers, binder, and synthetic polymer fiber.

10. The urn of claim 9 wherein physical fastening elements are present as part of said urn.

11. The urn of claim 1 wherein ashes are present in said urn with a porous material which will allow passage of water but will not allow movement of at least 50% by weight of said ashes through it, is present between said openings and ashes.

12. A funerary urn comprising a top, a bottom, and side walls connecting said top and bottom, said urn having an open area within a first storage space defined by said top, bottom and side walls with between 0.25 and 5 cubic feet of space, said top, bottom and side walls having openings therein which will allow passage of water into said first storage space and air out of said first storage space, said urn, when containing the ashes of a cremated animal and then immersed in water, will achieve a specific gravity of greater than 1.0 within three minutes, at least 80% by weight said top, bottom and side walls consisting essentially of materials which would decompose, degrade, dissolve, or disperse in water so that said urn will lose its structural integrity within twelve months of continued immersion in water at 20° C., 80% by total weight of said urn comprises biodegradable materials, and wherein porous material, which will allow passage of surrounding water but will not allow movement of at least 50% by weight of ash particles through it, is present between said openings and ash stored within a second storage space within said first storage space, allowing contact of said surrounding water and said ash stored within said second storage space and wherein when said urn is placed into water and released, said openings are positioned about said urn that, no matter what orientation of the urn is effected, at least one opening is below water and at least one opening is above water.

13. The urn of claim 12 wherein said porous material comprises paper or mesh.

14. The urn of claim 12 wherein said porous material comprises paper or a mesh of soluble fibers.

* * * * *